United States Patent [19]

Witt

[11] Patent Number: 4,742,863

[45] Date of Patent: May 10, 1988

[54] MOLD FOR SAND CASTING VARYING THICKNESS ARTICLES

[76] Inventor: Raymond H. Witt, 28240 Grand River, Farmington, Mich. 48024

[21] Appl. No.: 42,855

[22] Filed: Apr. 27, 1987

Related U.S. Application Data

[62] Division of Ser. No. 882,830, Jul. 7, 1986, Pat. No. 4,674,553.

[51] Int. Cl.[4] ..... B22C 9/12

[52] U.S. Cl. ..... 164/255; 164/364; 164/349; 249/114 R

[58] Field of Search ..... 164/7.1, 14, 15, 23, 164/27, 29, 33, 72, 160.1, 237, 238, 349, 361, 364, 255; 249/114 R, 115

[56] References Cited

FOREIGN PATENT DOCUMENTS

| | | | |
|---|---|---|---|
| 1226747 | 10/1966 | Fed. Rep. of Germany | 164/33 |
| 60-166160 | 8/1985 | Japan | 164/255 |
| 0829330 | 5/1981 | U.S.S.R. | 164/33 |

*Primary Examiner*—Nicholas P. Godici
*Assistant Examiner*—Richard K. Seidel
*Attorney, Agent, or Firm*—Cullen, Sloman, Cantor, Grauer, Scott and Rutherford

[57] ABSTRACT

A permanent casting mold has its casting cavity coated with a sand liner of varying thickness. The liner is thicker where the cast article section is thinner and the liner is thinner where the cast article section is thicker so as to permit the thicker sections to cool faster while the thinner sections cool slower. The different thicknesses of the liner are correlated so that the respective sections of the article are sufficiently cooled at about the same time for removal of the article from the mold. The mold is a cope and drag-type flask mold whose casting cavity halves are oversized relative to the cast article. The sand liner is formed therein by temporarily positioning a pattern within the permanent casting cavity halves and sand filling the space between the pattern and cavity wall. The exterior surface of the pattern corresponds to the cast surface of the article. Thus, the thicknesses of the different portions of the liner are determined by the amount that the corresponding portions of the casting cavity are oversized. A vacuum system opening into the casting cavity, when the cope and drag are closed together for casting, enables rapid filling of the sand-lined cavity with molten metal, wherein the entire casting process, including cooling of the cast article for removal, is performed rapidly.

7 Claims, 1 Drawing Sheet

MOLD FOR SAND CASTING VARYING THICKNESS ARTICLES

This is a division of application Ser. No. 882,830, filed July 7, 1986, now U.S. Pat. No. 4,674,553.

BACKGROUND OF INVENTION

The casting of articles from molten metal in cavities formed in sand molds is a commonly used procedure. Generally, this procedure involves forming a mold cavity by packing sand around a pattern, removing the pattern, pouring molten metal into the cavity and then allowing the metal to cool and solidify. Each mold is used only once.

In cases of a high production demand for specific cast articles, a common procedure has been to make the molds of permanent materials, such as steel or iron or graphite, within which the casting cavities have been permanently machined. Here, each mold may be reused a number of times. The use of permanent molds depends, to a considerable extent, upon the quantity of production, the nature and size of the cast article to be produced, the expenses for making the molds, etc.

In the casting of ferrous metals, attempts have been made in the past to combine the benefits of sand casting molds, with the longevity of and ease of handling of permanent molds, by applying a sand or sand-like coating over the cavity wall within a permanent mold. In high production casting in permanent molds, it is desirable to cool the molten metal as rapidly as feasible so as to more rapidly remove the finished casting from the mold. But, since sand is an insulating material, it slows the cooling of the cast article within the permanent mold as compared to the more rapid cooling in an uncoated permanent mold.

Moreover, where the cast article has sections that are thicker than other sections, the thicker sections normally cool more slowly than the thinner sections. Thus, the thicker sections determine the length of time needed before the finished article can be removed from the mold. Because the thicker sections cool more slowly than the thinner sections, structural and metallurgical problems have been encountered due to the differential in cooling between integral thick and thin sections resulting in part of a casting being substantially cooled and adjacent parts being less cooled at the same time. The use of sand in permanent mold cavities tend to increase the differential cooling problems. Thus, the invention herein is concerned with the utilization of permanent molds whose cavities are sand lined, but wherein the thicknesses of the various parts of the sand liner are varied in a way that causes varying cooling of the cast article within the mold so as to permit a faster casting and removal cycle and to produce a better cast product.

SUMMARY OF INVENTION

The invention herein contemplates casting of articles from molten metal within a permanent mold whose cavity wall is lined with sand. The thickness of the sand liner is varied to reversely correlate with the thickness of the sections of the cast article. That is, where the cast article sections are thicker, the sand liner portions are made thinner, and vice-versa. Thus, the thinner sections of the article cool slower because they are adjacent thicker sand wall portions, whereas the thicker sections of the cast article cool more rapidly because they are adjacent thinner sand wall portions. By suitably correlating the thicknesses of the sand liner with the casting section thicknesses, the rates of cooling within each section of the casting may be varied, but the overall cooling of all the sections results in the casting being adequately cooled throughout at about the same time. Hence, the casting may be removed from the mold more rapidly and the casting itself may be of a better quality due to the controlled cooling.

Preferably, the mold used in in the form of a cope and drag, flask-type mold having cavity halves formed in each of the two mold parts. When the cope and drag are closed together, their cavity halves are aligned to form the complete casting cavity. The casting cavity is coated with the sand liner so that the benefits of sand casting are achieved even though the mold is of the permanent type.

The sand liner may be applied within the pre-formed, oversized mold cavity by positioning a pattern within a cavity half and blowing molding said into the space between the pattern and the mold wall to form the liner. Each sand liner is separately formed within the cavity of its respective mold half.

By forming the exterior surface of the pattern to correspond to the casting wall surface size and shape, the sand wall surface within the cavity casts an accurate replica of the pattern. However, the thickness of the sand lining may be adjusted or controlled by means of adjusting the size of the cavity at various places within the cavity.

The cavity utilized in this process is oversized so that when the sand is applied to the cavity wall, the finished cavity is reduced in size to conform to the desired casting size. Consequently, by making the permanent cavity more or less oversized in different places, the thickness of the sand liner at such places will vary accordingly because of the variation in the space or gap between the pattern and the permanent cavity wall. By appropriately calculating the heat insulation effect of different thickness of the particular sand utilized, the required thicknesses of the sand wall portions can be obtained merely by slightly increasing or slightly decreasing the size of the already oversized cavity to accommodate more or less sand at any particular location on its surface.

An object of this invention is to provide a mold and a molding process which utilizes the benefits of both sand mold casting and permanent mold casting and, in addition, provides a means for correlating the different rates of cooling different thickness, integral sections of the cast article.

Another object of this invention is to provide a casting mold which is relatively simple in construction, can be reused many times and which will produce accurate castings rapidly while selectively controlling the rate of cooling of the castings.

Still a further object of this invention is to provide a casting system which produces better castings faster and permits the reduction in the amount of thicker and thinner casting sections.

These and other objects and advantages of this invention will become apparent upon reading the following description, of which the attached drawings form a part.

DETAILED DESCRIPTION

Figure 1:
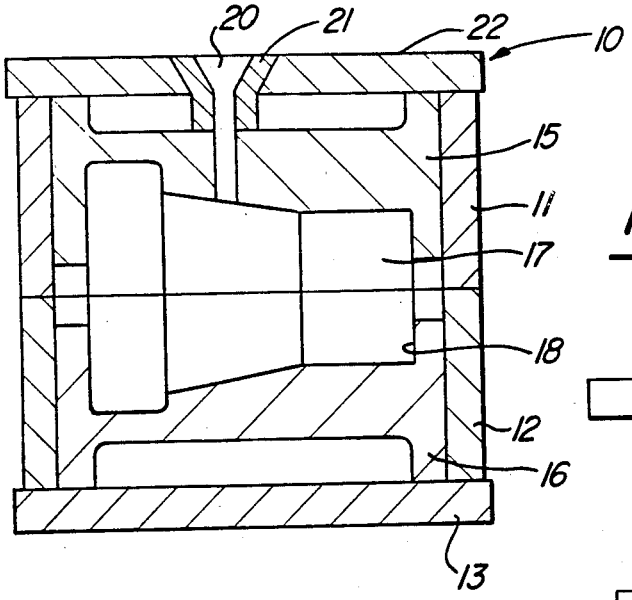
FIG. 1 is a schematic, cross-sectional view of the permanent cope and drag mold of this invention.

FIG. 1 schematically illustrates a molding flask 10 formed of a cope or upper frame 11 and a drag or lower frame 12 rested upon a support platform or board 13. This general type of molding flask is commonly used for either sand casting or permanent mold casting. Thus, it is illustrated here as exemplary.

A permanent mold 15 is carried within the cope and a similar permanent mold 16 is carried within the drag. These molds are formed of a permanent or long-lasting material, such as iron, steel or graphite. The upper permanent mold contains an upper or cope cavity half 17. A lower cavity half 18 is formed within the drag mold. For purposes of illustration, the cavity halves are shown to be symmetrical, that is, for molding a symmetrical article. However, in a typical casting operation, the cavity "halves" differ in size and shape to correspond to a non-symmetrical-shaped part.

In order to pour molten metal, such as iron or steel or aluminum or the like, into the cavity, a pouring sprue 20 is provided. This is schematically shown as being formed of a funnel-like insert 21 that is extended through the cover or lid 22 which is placed over the top of the cope. Ordinarily, in casting molten metal, the molten metal is poured into a sprue and through gates or passages into one or more cavities within the mold. Suitable vents are provided for the escape of gases. All of this is omitted from the drawings which are intended to be schematic representations focusing on the subject matter of this invention.

As is typical in sand mold casting, a pattern half 25, mounted upon the lower surface of a support board 26, is used to form the cavity in the sand. A corresponding half (not illustrated) is utilized to make the cavity in the opposite part of the mold, in this case, the cope.

Figure 2:
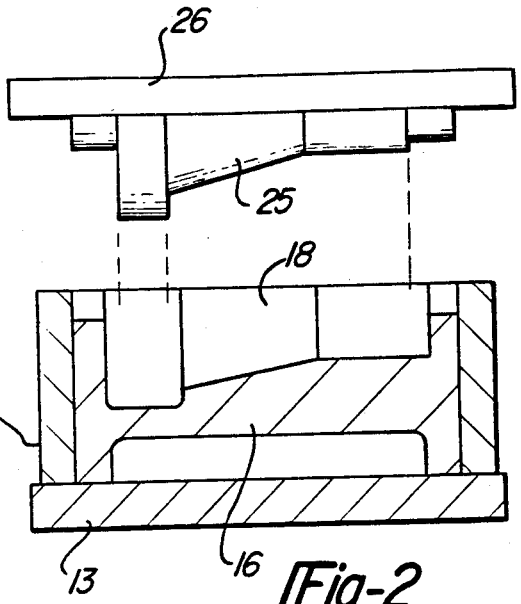
FIG. 2 is a schematic, cross-sectional view of the mold drag with the pattern positioned above it prior to insertion of the pattern for forming the sand liner.
Figure 3:
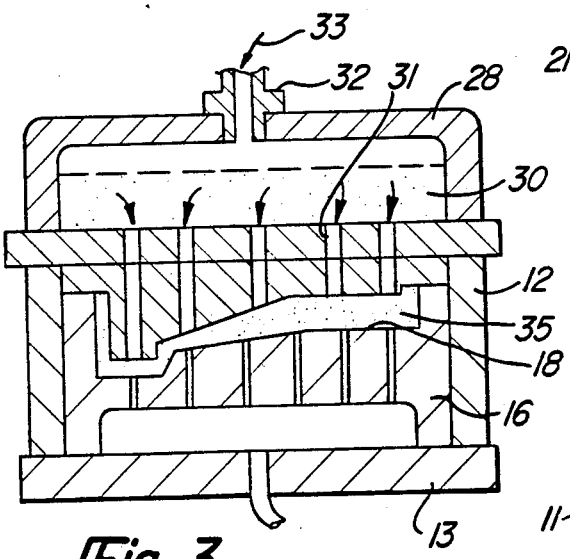
FIG. 3 is a schematic, cross-sectional view showing the pattern located within the drag and the application of sand into the drag cavity.

As shown in FIGS. 2 and 3, the pattern half 25 is positioned within the lower cavity half 18. The surface of the pattern corresponds to the desired surface of the cast article. The interior wall surface of the cavity half, however, is oversized relative to the finished surface of the cast article. Thus, there is a space or gap between the surface of the pattern and of the cavity. That gap or space is filled with sand to form the interior casting wall of the cavity.

As shown schematically in FIG. 3, the sand is applied by positioning a suitable container or sand box 28 over the pattern. In high production, the pattern support board 26 could be utilized as the bottom of the sand box 28 or could be attached to a more permanent box bottom. In any event, the pattern support board 26 and the pattern 25 are provided with numerous holes 31 through which the sand may flow into the space between the pattern and the cavity half wall. The sand may be driven through the holes by using compressed air which flows through a compressed air fitting 32 in the sand box 28. The compressed air is schematically indicated by the arrow 33 and the smaller arrows within the sand box 28. A suitable commercially available air compressor may be used to supply the compressed air.

The sand liner 35, which is formed in the space between the pattern and the permanent mold cavity, may be made of any suitable commercially available sand material, such as core sand or green sand or mixtures of sand and suitable binders, etc. Once the sand is packed into the space to form the liner, its interior surface forms a sand casting cavity 36 within the permanent mold cavity. (See FIG. 4.)

Significantly, the thickness of the sand liner varies in accordance with the variations in the cast article. That is, the thickness of the sand liner is correlated, either by trial and error or by experience from past castings, to the corresponding thickness of the casting. The thicker sections of the casting are formed within corresponding thinner liner portions and the thinner sections of the casting are formed within corresponding thicker liner portions. This is illustrated schematically in the drawings which exaggerate the varying thicknesses of the sand liner. By way of example, it is contemplated that the sand liners will be of a wall thinkness of between about 0.075 to 0.300 inches, plus or minus, to cast sections of metal ranging down to about 0.80–0.140 inches in wall thickness.

Figure 4:
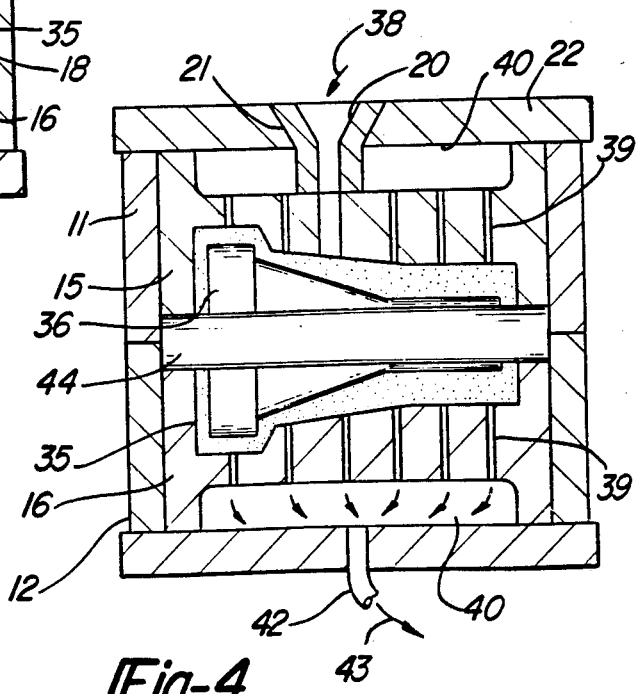
FIG. 4 is a schematic, cross-sectional view showing the complete, sand-lined mold ready for casting the molten metal.

After the sand liner cavity 36 is formed in both the cope and the drag, the patterns are removed and the flask is reassembled or closed. At that point, molten metal, illustrated by the arrow 38 in FIG. 4, is poured into the sprue 20, which is extended through the sand liner, to fill the cavity. During the time of the gravity pouring of the molten metal, it is desirable to apply a vacuum within the cavity to enhance the distribution of the molten metal and its speed of cooling. Thus, exhaust holes 39 and 40 are formed in the permanent mold upper and lower halves 15 and 16, respectively, to communicate with vacuum chambers 40. The chambers are connected through a conduit 42 (illustrated schematically in FIG. 4) to a vacuum source, such as a commercially available vacuum pump (designated schematically by the arrow 43). The amount of vacuum required will depend upon the nature of the material poured and can be determined by trial and error.

After the pouring of the metal, the sections of the metal solidify at different rates because of the different insulating effect of the surrounding portions of the sand liner. Thus, the thicker sections will cool faster where the liner is thinner while the thinner sections will cool slower because of the greater insulation effect of the thicker portion of the liner. By correlating the rates of cooling, all of the sections of the complete cast article can be timed to cool to the required removal temperature at about the same time. Because the rate of cooling of the thicker sections is speeded up relative to that of the thinner sections, the complete article tends to cool better, with less internal stresses and resulting cracking or other cooling caused problems, at an overall faster rate than would be expected. This permits faster removal of the part from the molds because the complete part is cooled to its removal temperature faster, while simultaneously producing a better casting. This system makes it possible to use thinner metal wall sections than might otherwise be required in metal castings to provide the same results obtained in conventional casting.

Figure 5:
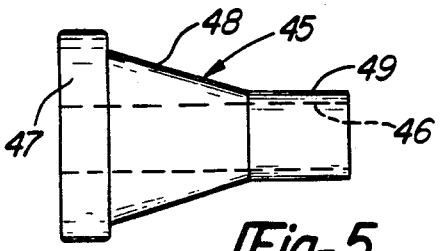
FIG. 5 is an elevational view of an example of a cast article.

The system of casting described here also permits the use of metal of a viscosity which is more fluid than normally used casting metal. This permits faster casting and cooling and, also, better metallurgical characteristics in the resulting cast article.

Where required by the design of the cast article, a suitable core 44 (see FIG. 4) may be inserted within the mold prior to casting. As illustrated in FIG. 5, a finished cast part 45 is produced having a central bore 46 made with such a core. This part has a thick section flange 47 at one end, a central, tapered wall thickness section 48 and an end, thin wall section 49. Obviously, the shape, wall thicknesses and size of the part may be varied considerably. But, in any event, once the part is cast, the mold halves may be opened sooner, for quicker removal of the casting, than is normal in conventional casting operations. Further, it has been found that in this kind of procedure, the surfaces of the cast part are generally of a significantly better quality than in normal casting, i.e. the surfaces are less rough and are less prone to having defects.

Having fully described an operative embodiment of this invention, I now claim:

1. A sand casting mold for casting molten metal articles of varying thicknesses, comprising:

a permanent mold having a pre-formed casting cavity which is oversized relative to the desired finished external size and shape of the cast article;

a sand liner applied upon the wall of the casting cavity to provide an interior sand wall surface corresponding to the desired finished cast article surface;

said liner having varied thickness portions reversely correlated to the varied thickness sections of the cast article, that is, the liner portions being thicker where the article is thinner and vice-versa, with the liner thicknesses being pre-selected so that the different thickness article sections cool at different rates, i.e. with thicker sections cooling faster than the thinner sections, but with the liner thicknesses being correlated for sufficiently cooling all of the varied thickness sections of the cast article at about the same time to a temperature for removal of the article from the mold.

2. A sand casting mold as defined in claim 1, and said mold being formed as a cope and drag-type flask, with each of the cope and drag having a portion of the casting cavity and its interior sand liner.

3. A sand casting mold as defined in claim 2, and including small-size openings formed through the permanent mold and communicating with the interior of the mold cavity;

and vacuum applying means external of the mold for applying a vacuum, through said small size openings, within the casting cavity during the time that the molten metal is cast.

4. A sand casting mold for casting molten metal articles which have integral thicker, cross-sectional portions and thinner, cross-sectional portions, comprising:

a permanent mold having a preformed cavity within which the molten metal is cast and solidified into the article;

said cavity being oversized relative to the desired finished external size and shape of the cast article, with the wall defining the cavity being spaced a predetermined, varying distance away from the surface of the article cast within the cavity, that is, the wall being shaped and sized so that the distances between the wall areas that overlap the article thicker and thinner portions are correlated to be greater for the article thinner portions and lesser for the article thicker portions;

a sand liner applied against the wall of the casting cavity and forming an interior sand wall surface corresponding to the desired finished cast article surface and against which the molten metal is cast to form the cast article;

the thickness of the sand liner corresponding to the varying distance between the sand wall surface and the wall defining the cavity in the permanent mold, whereby the liner thickness varies reversely in accordance with the thickness of the article portions, so that the liner is thicker where the corresponding cast article portions are thinner and the liner is thinner where the corresponding cast article portions are thicker;

and with the distances between the permanent mold wall and the sand mold surfaces being predetermined for correlating the molten metal to cool at different rates at the different thickness portions of the article, that is, with the thicker portions cooling faster than the thinner portions, and with said distances, and therefore, said liner thicknesses, being correlated for sufficiently cooling the molten metal at all of the varied thickness portions of the cast article at about the same time to a temperature permitting removal of the cast article from the mold.

5. A sand casting mold as defined in claim 4, and including said mold being formed as a cope and drag type flask, with each of the cope and drag having a portion of the permanent mold, with its portion of the casting cavity, and a portion of the interior sand liner.

6. A sand casting mold as defined in claim 5, and wherein the distances between the permanent mold cavity wall and the samd wall surface change gradually along the areas of the mold overlapping portions of the cast article which gradually change in thickness, with the change in distance being the opposite to the change in the thickness of the overlapped portions of the article.

7. A sand casting mold as defined in claim 11, and including small size openings formed through the permanent mold and communicating with the interior of the mold cavity;

and means for applying a vacuum, located externally of the mold, for applying a vacuum through said small size openings within the casting cavity during the time that the molten metal is cast.

* * * * *

UNITED STATES PATENT AND TRADEMARK OFFICE

CERTIFICATE OF CORRECTION

PATENT NO. : 4,742,863

DATED : May 10, 1988

INVENTOR(S) : Raymond H. Witt

It is certified that error appears in the above-identified patent and that said Letters Patent is hereby corrected as shown below:

In claim 6, col. 6, line 42, change "5" to --4--
and in line 44, change "samd" to --sand--.

In claim 7, col. 6, line 50, change "11" to --4--

Signed and Sealed this

Eleventh Day of October, 1988

*Attest:*

DONALD J. QUIGG

*Attesting Officer*

*Commissioner of Patents and Trademarks*